US006270341B1

(12) United States Patent
Garcia

(10) Patent No.: US 6,270,341 B1
(45) Date of Patent: Aug. 7, 2001

(54) HOLDER FOR SPRING-LOADED CANDLE SLEEVE

(75) Inventor: Pete F. Garcia, Atlanta, GA (US)

(73) Assignee: Garcia Group, Inc., Atlanta, GA (US)

( * ) Notice: Subject to any disclaimer, the term of this patent is extended or adjusted under 35 U.S.C. 154(b) by 0 days.

(21) Appl. No.: 09/556,168

(22) Filed: Apr. 21, 2000

(51) Int. Cl.[7] ..... F23D 3/16
(52) U.S. Cl. ..... 431/290; 431/288; 362/161
(58) Field of Search ..... 431/290, 291, 431/288, 296; 362/161–163, 101, 159

(56) References Cited

U.S. PATENT DOCUMENTS

| | | | | |
|---|---|---|---|---|
| 166,651 | * | 8/1875 | Swann | 431/290 |
| 2,480,333 | * | 8/1949 | McClory | 431/290 |
| 3,371,508 | * | 3/1968 | Nelson | 431/290 |
| 4,186,430 | * | 1/1980 | Britton | 362/290 |
| 4,681,534 | * | 7/1987 | Schneke et al. | 431/290 |

FOREIGN PATENT DOCUMENTS

16003 * of 1891 (GB) .

* cited by examiner

*Primary Examiner*—James C. Yeung
(74) *Attorney, Agent, or Firm*—Gardner Groff Mehrman & Josephic, P.C.

(57) ABSTRACT

A decorative candle holder for supporting a spring-loaded candle sleeve in an upright position. The holder comprises a shell forming a cavity therethrough, a base, an upper aperture, a lower aperture and feet. The lower aperture and the cavity are dimensioned for receiving the candle sleeve. In the preferred form, the upper aperture has a diameter slightly smaller than the diameter of the sleeve such that the tip of the sleeve rest within the upper aperture but does not extend therethrough. The bottom of the sleeve is frictionally secured within the lower aperture by preferably a flexible ring that is slidably engaged with the sleeve and is of sufficient thickness to snugly fit radially between the bottom of the sleeve and the walls of the lower aperture. Preferably, feet are attached to the bottom of the holder to further assist in supporting the holder in an upright position.

10 Claims, 2 Drawing Sheets

HOLDER FOR SPRING-LOADED CANDLE SLEEVE

TECHNICAL FIELD

The present invention relates generally to candle holders and, more specifically, to a decorative candleholder for a spring-loaded candle sleeve.

BACKGROUND OF THE INVENTION

It has been well known for decades that the glow and aura of candlelight can be both romantic and therapeutic. As a result, many fine restaurants and clubs have incorporated the use of candles to enhance the ambiance and romantic setting for their customers. In addition, candles are often used for relaxation and stress reduction. Consequently, candles are enormously popular and widely utilized.

One style of candle that has been popular for many years is the elongated candle. This candle is generally elongated and has a wick at its distal end. Traditionally, the candle is held in an upright position by frictionally engaging the proximal end of the candle within a candle holder. In use, as the candle burns, the wax surrounding the wick melts and evaporates and thus the length of the candle shrinks. To maintain a consistently level flame and the appearance of an ever-burning non-shrinking candle, a spring-loaded candle sleeve was invented.

The spring-loaded candle sleeve typically is constructed of an elongated rigid outer shell forming a cavity therein for receiving a candle. As such, the candle sleeve is shaped and dimensioned substantially similar to a candle. In use, the candle sleeve is secured in the upright position by inserting the bottom of the candle sleeve into any one of many known candle holders.

A spring-loaded insert typically is positioned concentrically within the candle sleeve and extends generally the length thereof for urging the candle up to an aperture formed at the upper portion of the candle sleeve, wherein the wick of the candle extends therethrough. Consequently, as the candle burns and shrinks longitudinally due to the evaporation, consumption of the wax, the spring-loaded insert continuously urges the candle upwardly toward the aperture. Thus, a consistent horizontally positioned flame results. More specifically, as viewed by an observer, the candle sleeve gives the appearance of an ever-burning, non-shrinking candle.

The spring-loaded candle sleeve alone, however, is disadvantageous. For instance, because of its size, shape and functionality, the prior art candle sleeve is reasonably incapable of being formed into various configurations and is further limited as to its degree of possible ornamentation. Unfortunately, candle-holding bases are often unappealing and fail to provide a decorative means for encasing the entire candle sleeve.

Accordingly, a new and improved decorative candle holder for a spring-loaded candle sleeve is needed that provides a decorative means for encasing the entire candle sleeve.

SUMMARY OF THE INVENTION

Briefly described, in a first preferred form the present invention both overcomes the above-mentioned disadvantages, and meets the recognized need for such a device, by providing a freestanding holder for a spring-loaded candle sleeve.

Generally, the present device comprises a holder in the form of a decorative cover forming a cavity therethrough, wherein the cover has an upper aperture and a lower aperture. The lower aperture and the cavity are dimensioned for receiving the candle sleeve therein. In the preferred form, the upper aperture has a diameter slightly smaller than the diameter of the sleeve such that the tip of the sleeve rests within the upper aperture, but does not extend therethrough. The bottom of the sleeve is frictionally secured within the lower aperture, preferably by a flexible ring that is slidably engaged with the sleeve and is of sufficient thickness to snugly fit radially between the bottom of the sleeve and the walls of the lower aperture. Optionally, feet or friction material can be attached to the bottom of the holder to help support the holder in an upright position.

Because the holder can be of almost any shape, a plurality of decorative and appealing designs, artwork and insignia can be formed thereon. Consequently, the holder is not limited to the shape of a candle.

In use, a candle is inserted within the sleeve with the wick of the candle extending to the top of the sleeve. With the sleeve inserted into the holder, the wick extends out of the holder through the upper aperture. As the candle burns and shrinks due to evaporation of the wax surrounding the flame, the spring-loaded sleeve urges the candle up against the upper aperture. Thus, a consistently horizontally level flame is produced. When it is necessary to replace the candle, the bottom of the sleeve and the spring-loaded insert are removed, another candle is inserted into the sleeve and the insert is replaced. The bottom of the sleeve, in the preferred form, extends slightly below the holder to allow replacement of the candle without removing the entire sleeve from the holder.

Accordingly, it is an object of the present invention to provide a new and improved candle holder that supports a spring-loaded candle in an upright position.

It is another object of the present invention to provide a new and improved candle holder that encases and conceals a spring-loaded candle.

It is yet a further object of the present invention to provide a new and improved candle holder that is decorative and can be formed into a multitude of appealing shapes, styles, designs, etc.

It is yet a further object of the present invention to provide a new and improved freestanding candle holder for holding a spring-loaded candle.

It is yet a further object of the present invention to provide a new and improved candle holder for holding a spring-loaded candle wherein the candle can be replaced within the candle sleeve without removing the entire candle sleeve from the holder.

It is yet a further object of the present invention to provide a new and improved candle holder for holding a spring-loaded candle to provide a consistent horizontally level flame.

BRIEF DESCRIPTION OF THE DRAWING FIGURES

The present invention will be better understood by reading the Detailed Description of the Preferred Embodiment with reference to the accompanying drawing figures, in which.

DETAILED DESCRIPTION OF THE PREFERRED EMBODIMENT

Figure 1:
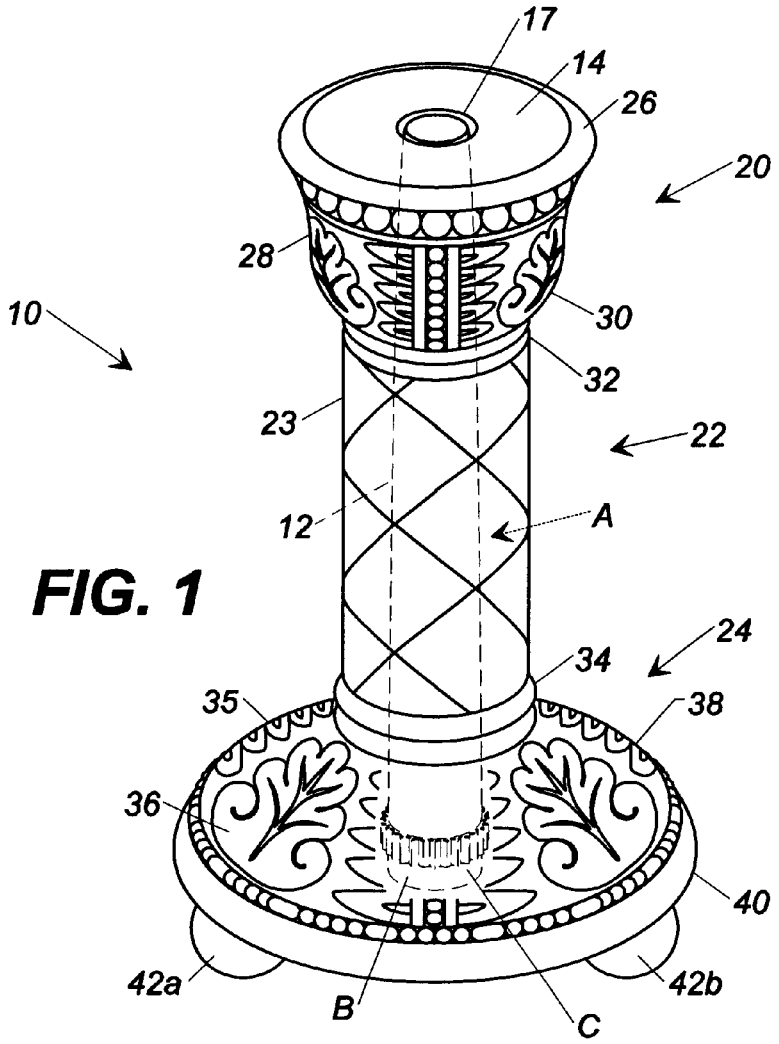
FIG. 1 is a perspective view of the device according to a preferred embodiment of the present invention showing a spring-loaded candle inserted therein.
Figure 2:
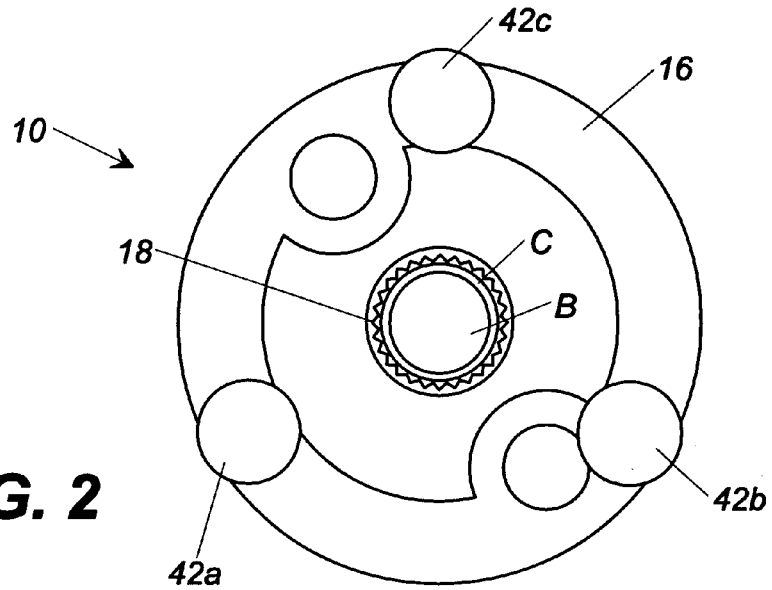
FIG. 2 is a bottom view of the device of FIG. 1 and showing a spring-loaded candle inserted therein.
Figure 3:
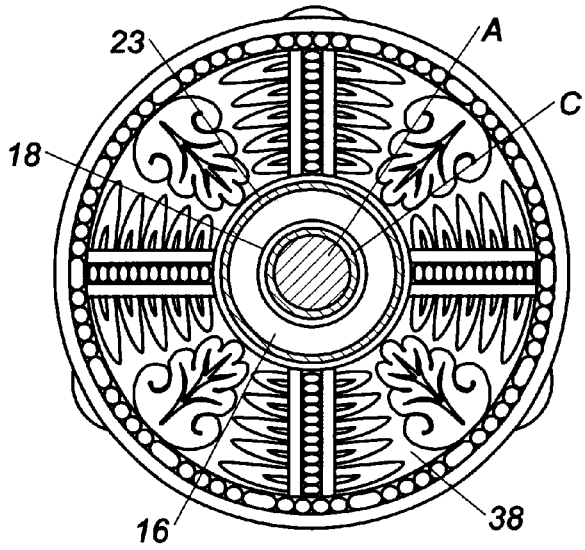
FIG. 3 is a sectional view of the device of FIG. 1.
Figure 4:
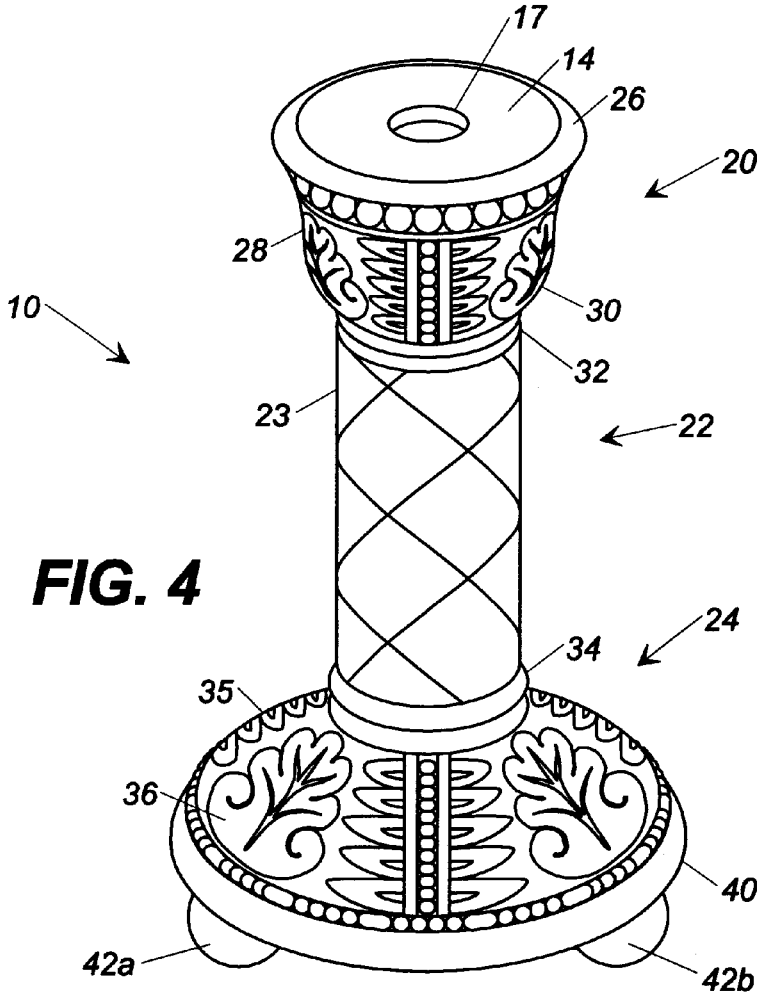
FIG. 4 is a perspective view of the device of FIG. 1.

In describing the preferred and alternate embodiments of the present invention, specific nomenclature is employed for the sake of clarity. The invention, however, is not intended to be limited to the specific nomenclature so selected.

Referring now in detail to the drawing figures, wherein like reference numerals represent like parts throughout the several views, the herein disclosed device 10 is a decorative stand/cover for a spring-loaded candle sleeve A, of the type commonly available. The candle sleeve A typically is constructed of an elongated rigid outer shell forming a central cavity therein for receiving a typical and well-known elongated candle. As such, the candle sleeve A is shaped and dimensioned substantially to match a candle. In use, the typical prior art candle sleeve A is secured in the upright position by placing the bottom of the candle sleeve A downwardly into any one of many known candle holders. Typically, the prior art candle holders have flexible prongs, groves, or tabs positioned in a generally circular pattern for frictionally receiving the bottom of the candle sleeve A.

A spring-loaded insert B typically is positioned concentrically within the candle sleeve A and extends generally the length thereof for urging the candle to an aperture formed at the upper portion of the candle sleeve A. Consequently, as the candle burns and shrinks longitudinally due to the evaporation of the wax, the spring-loaded insert B continuously urges the candle upwardly toward the aperture. Thus, a consistent, horizontally positioned flame results. More specifically, as viewed by an observer, the candle sleeve A gives the appearance of an ever-burning, non-shrinking candle.

The present device 10 serves to support and encase the candle sleeve A in an upright position without the use of traditional prong holders. As a result, a multitude of decorative shapes and indicia can be formed thereon.

In the preferred form, the device 10 generally comprises a top 14, a bottom 16, a first aperture 17, a second aperture 18, a head portion 20, a neck portion 22, a base portion 24 and feet 42*a,* 42*b,* 42*c.* More specifically, the head portion 20 is generally inverted-bell shaped. A top circumferential edge 26 mates with and encircles the top 14. A bell-shaped surface 30 extends radially the circumference of the device 10 and longitudinally from a top end 32 of the neck portion 22 upward to the top circumferential edge 26. A plurality of decorative designs 28 or indicia are formed on the circumferential surface of the bell-shaped surface 30.

The neck portion 22, preferably, is generally cylindrical and extends longitudinally between the base portion 24 and the head portion 20. A plurality of decorative designs 23 or indicia are formed on the circumferential surface of the neck portion 22.

In the preferred form, the base portion 24 is generally bell-shaped. A top edge 35 of the base portion 24 mates circumferentially with a bottom end 34 of the neck portion 22. A bottom edge 40 of base portion 24 mates circumferentially with the bottom 16. A bell-shaped surface 36 extends radially the circumference of the device 10 and longitudinally from the bottom 16 to the bottom end 34 of the neck portion 22. A plurality of decorative designs 36 or indicia are formed on the circumferential surface of the base portion 24.

Preferably, the bottom 16 has a sufficient diameter to support the device 10 having the candle sleeve A and a candle therein in an upright position. To further assist in supporting the device 10 in an upright position, spherically-shaped feet 42*a,* 42*b* and 42*c* are formed on the bottom 16. It should be noted that other shaped feet such as, for exemplary purposes only, rectangular, triangular and cylindrical may be utilized.

The second aperture 18 and the cavity 12 are dimensioned for receiving the candle sleeve A. In the preferred form, the first aperture 17 has a diameter slightly smaller than the diameter of the candle sleeve A such that the tip of the candle sleeve A rest against the top 14 and within the first aperture 17 but does not extend therethrough.

In use, candle sleeve A is inserted into the cavity 12 via the second aperture 18 until the tip of the candle sleeve A rest against the top 14 and within the first aperture 17. The bottom of the candle sleeve A is frictionally secured within the second aperture 18 by preferably a flexible ring C that is slidably engaged with the candle sleeve A and is of sufficient thickness to snugly fit radially between the bottom of the candle sleeve A and the walls of the second aperture 18. It should be noted that any one of many known attaching means such as, for exemplary purposes only, tongue-and-groove, U-shaped clamp, threads or a securing arm, may be utilized. Preferably, a bottom portion of the spring-loaded insert B extends slightly below the bottom 16 to facilitate the removal of the spring-loaded insert B. The spring-loaded insert B of the candle sleeve A is removed by twisting and disengaging the exposed portion of the spring-loaded insert B. Once the spring-loaded insert B is removed, a candle is inserted into the candle sleeve A until the wick of the candle extends through first aperture 17. The spring-loaded insert B is then reinserted and re-engaged to continuously urge the candle upward to the first aperture 17. Thus, when lit, a consistent horizontally positioned flame results. More specifically, as viewed by an observer, the candle sleeve A gives the appearance of an ever burning, non-shrinking candle.

Although the above disclosure discusses use of the present device 10 with elongated candles, it should be noted that one skilled in the art would appreciate other embodiments for various shaped candles. For instance, the shape of both the sleeve A and the present device 10 can be varied to accommodate, for exemplary purposes only, cylindrical, rectangular and triangular candles. It should also be noted that as long as the cavity 12 and the second aperture 18 are dimensioned to receive the sleeve A, a multitude of exterior shapes, designs and indicia are contemplated.

Device 10 can be formed from a shell or a solid member having a passageway formed therein. Additionally, a variety of materials are contemplated for forming device 10. For example, ceramic, plastic, metal and/or wood may be utilized.

Having thus described the preferred forms of the present invention, those skilled in the art will additionally recognize that the within disclosures are exemplary only, and that various other alternatives, adaptations, and modifications may be made within the spirit and scope of the present invention as set forth in the following claims.

What is claimed is:

1. A device for holding a spring-loaded candle sleeve mechanism, wherein the spring-loaded candle sleeve mechanism has an outer sleeve with a first end and a second end, and a spring-loaded insert sleeve positionable concentrically within the outer sleeve, extending generally the length of the outer sleeve, and adapted for receiving a candle therein, said device comprising:

a body having an upper end and a lower end, said body defining a cavity therethrough for receiving the outer sleeve of the spring-loaded candle sleeve mechanism;

a first aperture formed in said upper end, said first aperture being dimensioned to be smaller than the first end of the outer sleeve; and a second aperture formed in said lower end, said second aperture being dimensioned for receiving the outer sleeve therein, wherein upon insertion, the first end of the outer sleeve is held adjacent said upper end of said body at said first aperture, and wherein the second end of the outer sleeve rests within said lower end of said body at said second aperture.

2. The device of claim 1, further comprising means for securing the spring-loaded candle sleeve mechanism within said body.

3. The device of claim 2, wherein said securing means is a flexible ring concentrically carried at the second end of the outer sleeve such that said flexible ring frictionally engages with said lower end of said body.

4. The device of claim 1, wherein said body further comprises feet positioned at said lower end of said body for supporting said device in an upright position.

5. A device for holding a spring-loaded candle sleeve mechanism, wherein the spring-loaded candle sleeve mechanism has an outer sleeve with a first end and a second end, and a spring-loaded insert sleeve positionable concentrically within the outer sleeve, extending generally the length of the outer sleeve, and adapted for receiving a candle therein, said device comprising:

a body having an upper end and a lower end, said body defining a cavity extending therethrough for receiving the outer sleeve of the spring-loaded candle sleeve mechanism;

a first aperture formed in said upper end, said first aperture being smaller then the first end of the outer sleeve so that the first end of the outer sleeve abuts said upper end but does not extend through or only a portion thereof extends through said first aperture of said first end;

a second aperture formed through said lower end, said second aperture being sized and adapted for receiving the outer sleeve therein; and means for securing the spring-loaded candle sleeve mechanism within said body so that the outer sleeve is secured to said body and the insert can be removed from the outer sleeve for removing or inserting the candle, wherein the first end of the outer sleeve is held adjacent said upper end of said body at said first aperture, and wherein the second end of the outer sleeve is held within said lower end of said body within said second aperture.

6. The device of claim 5, wherein said securing means comprises a flexible ring concentrically carried at the second end of the outer sleeve such that said flexible ring frictionally engages with said lower end of said body.

7. The device of claim 5, further comprising feet carried by said lower end of said body for supporting said device in an upright position.

8. A candle-holding device, comprising:

a spring-loaded candle sleeve mechanism having an outer sleeve with a first end and a second end, and a spring-loaded insert sleeve positionable concentrically within the outer sleeve, extending generally the length of the outer sleeve, and adapted for receiving a candle therein;

a shell having an upper end and a lower end, said shell defining a cavity therethrough for receiving the outer sleeve of the spring-loaded candle sleeve mechanism;

a first aperture formed through said upper end, said first aperture being dimensioned to be smaller than the first end of the outer sleeve so that the first end of the outer sleeve abuts said upper end but does not extend through or only a portion thereof extends through said first aperture of said first end;

a second aperture formed through said lower end, said second aperture being dimensioned for receiving the outer sleeve therein;

means for securing the spring-loaded candle sleeve mechanism within said shell; and feet positioned at said lower end for supporting said device in an upright position, wherein upon insertion, the first end of the outer sleeve rests against said upper end of said shell at said first aperture, and wherein the second end of the outer sleeve rests against said lower end of said shell within said second aperture.

9. The device of claim 8, wherein said securing means is a flexible ring concentrically carried at the second end of the outer sleeve such that said flexible ring frictionally engages with said lower end of said shell.

10. The device of claim 8, wherein said feet are spherically shaped.

* * * * *